US007368688B2

(12) United States Patent
Kim et al.

(10) Patent No.: US 7,368,688 B2
(45) Date of Patent: May 6, 2008

(54) APPARATUS AND METHOD FOR SENSING LOAD OF ELECTRIC COOKER

(75) Inventors: Eui Sung Kim, Gyeonggi-do (KR); Seung hee Ryu, Gyeonggi-do (KR); Doo Yong Oh, Seoul (KR); Byeong Wook Park, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/536,722

(22) Filed: Sep. 29, 2006

(65) Prior Publication Data

US 2007/0125768 A1 Jun. 7, 2007

(30) Foreign Application Priority Data

Dec. 2, 2005 (KR) ..... 10-2005-0116807

(51) Int. Cl.
*H05B 6/12* (2006.01)

(52) U.S. Cl. ..... 219/626; 219/601; 219/627; 219/665; 219/667; 99/325; 99/451

(58) Field of Classification Search ..... 219/620–627, 219/665–668, 601, 518; 99/325, 451, DIG. 14
See application file for complete search history.

(56) References Cited

U.S. PATENT DOCUMENTS 4,468,548 A * 8/1984 Yamaki ..... 219/601
4,638,135 A * 1/1987 Aoki ..... 219/627
2004/0222217 A1* 11/2004 Yang ..... 219/620

FOREIGN PATENT DOCUMENTS

EP 1049358 11/2000
JP 3-122991 * 5/1991 ..... 219/626

OTHER PUBLICATIONS

U.S. Appl. No. 11/426,024 to Kim et al., filed Jun. 23, 2006.
U.S. Appl. No. 11/456,979 to Oh et al., filed Jul. 12, 2006.

* cited by examiner

*Primary Examiner*—Philip H. Leung
(74) *Attorney, Agent, or Firm*—Greenblum & Bernstein, P.L.C.

(57) ABSTRACT

A heater unit is provided, the heater unit equipped with an induction heating coil and an electric heater selectively operated based on kind and state of a load of a cooking vessel placed on the heater unit. The kind is determined by an input current inputted when a load-type determination unit causes the induction heating coil to be operated and a resonance current flowing into the induction heating coil. The state is determined by a temperature change of the heater unit when a load-state determination unit allows the electric heater to generate heat, and the induction heating coil and the electric heater are selectively operated based on the determined kind and state of the load. Accordingly, a user needs not to scrupulously determine the kind of the cooking vessel and the electric cooker is not operated under a no-load state to prevent occurrence of safety accidents.

14 Claims, 4 Drawing Sheets

APPARATUS AND METHOD FOR SENSING LOAD OF ELECTRIC COOKER

CROSS-REFERENCE TO RELATED APPLICATIONS

This application claims priority under 35 U.S.C. §119 to Korean Patent Application No. 10-2005-0116807, filed on Dec. 2, 2005, the entirety of which is hereby incorporated by reference.

BACKGROUND OF THE INVENTION

This description relates to an apparatus and method for sensing load of an electric cooker.

In general, a cooker generates heat by using an electric heater or by burning fuels such as liquefied petroleum gas (LPG) or liquefied natural gas (LNG). Further, a cooking vessel is heated by the generated heat to thereby cook a predetermined type of food.

Although there are many kinds of cookers, an electric cooker capable of generating heat using electricity and cooking food thereby is very convenient and thus tends to be widely used.

In particular, studies on high output and high efficiency induction heating used as a major heat source of an electric cooker such as a hob or a cook top have been actively conducted.

An induction heating electric cooker supplies a high frequency electric current to an induction heating coil to generate high frequency magnetic flux. The high frequency magnetic flux is induced into a cooking vessel placed on the top of a heater unit by an induction effect to generate an eddy current in the cooking vessel. Joule heat is generated in a resistance portion of the cooking vessel by the generated eddy current. The cooking vessel is heated by the generated Joule heat.

Such an induction heating electric cooker has an advantage of excellent heating efficiency in a cooking vessel over an electric cooker using an electric heater.

However only a cooking vessel made of a magnetic substance containing iron ingredients can be used for Joule heat to be generated in the resistance portion of the cocking vessel by the eddy current. In other words, a cooking vessel made of a non-magnetic substance such as ceramics, glass or porcelain cannot be employed because the Joule heat is not generated therein.

Studies for overcoming such limitations in an induction heating electric cooker have been actively conducted. As a result, an induction heating electric cooker capable of heating not only a cooking vessel made of a magnetic substance containing iron ingredients but that of a non-magnetic substance such as copper or aluminum has been developed.

The cooking vessel made of a non-magnetic substance has a lower permeability than that of the cocking vessel made of a magnetic substance. Therefore, a heated cooking vessel made of a non-magnetic substance would increase an operation frequency, or the number of windings of an induction heating coil and a current.

However, an induction heating coil of an electric cooker capable of heating the cooking vessels made of magnetic and non-magnetic substances alike has a complicated structure as compared with that of the electric cooker capable of heating only the cooking vessel made of a magnetic substance. Further, in the electric cooker capable of heating the cooking vessels made of magnetic and non-magnetic substances, an inverter for supplying high frequency current to the induction heating coil has a complicated structure to increase subsequent economic costs.

Furthermore, the heating efficiency, when a cocking vessel made of a non-magnetic substance is heated, is remarkably lower than that of a heated cooking vessel made of a magnetic container. That is, the heating efficiency of an electric cooker for heating a cooking vessel made of a non-magnetic substance is lower than that of an electric cooker for heating a cooking vessel using radiant energy generated by an electric heater.

The induction heating electric cooker can be used to heat a cooking vessel made of a metallic material, regardless of magnetic or non-magnetic, but cannot be used to heat a cooking vessel made of a non-metallic material such as ceramic, glass or porcelain.

The use of radiant energy for heating a cooking vessel is known in the prior art. For example, EP No. 1,049,358 discloses a cooking vessel heated by radiant heat generated by an electric heater. According to the technique, an electric heater for heating a cooking vessel is installed at a central portion of a heater unit, and a conductive sensor loop is installed at an outer periphery of the electric heater. Further, a signal with a certain frequency generated by an oscillation circuit produces frequency displacement in accordance with existence or non-existence of the cooking vessel and also generates a phase difference between voltage and current.

The conductive sensor loop detects a phase difference between the voltage and current of the signal with a certain frequency from which displacement is generated according to presence or absence of the cooking vessel, and compares the detected phase difference between the voltage and current with a predetermined reference value to determine the presence or absence of the cooking vessel. Accordingly, the conductive sensor loop can determine whether heat is generated by the electric heater based on a result of the determination.

Likewise, the aforementioned conventional technique can be employed to detect only the presence or absence of a cooking vessel made of metal, but cannot detect the presence or absence of a cooking vessel made of glass, ceramic, porcelain or the like. Further drawback is that since a cooking vessel is heated by an electric heater, the aforementioned technique has lower heating efficiency as compared with that of case where a cooking vessel made of a magnetic substance is heated by an induction heating electric cooker.

Meanwhile, inventors of the present invention have developed an electric cooker in which a single heater unit equipped with both an induction heater and an electric heater is provided so that the induction heater and the electric heater can be selectively operated to heat the cooking vessel according to the kind of a cooking vessel placed on the heater unit.

The electric cooker mounted with both the induction and electric heaters provided in a single heater unit can selectively operate the induction heater or electric heater by a user's manipulation of a function key according to the kind of a cooking vessel.

Where a user selectively operates the induction heater or the electric heater, the user should personally determine whether a cooking vessel is made of a magnetic or non-magnetic substance. Further, the user should manipulate a function key for operating the induction heater when the cooking vessel is made of a magnetic substance, whereas the user should manipulate a function key for operating the electric heater when the cooking vessel is made of a non-magnetic substance, which have caused troubles and inconveniences.

Accordingly, it is preferable to first determine presence or absence of a cooking vessel and the kind of the cocking vessel placed on a heater unit and to selectively operate an induction heater or an electric heater based on a result of the determination.

SUMMARY

The present invention is conceived to solve the aforementioned problems. Accordingly, an object of the present invention is to provide an apparatus and method for sensing load of an electric cooker capable of detecting whether a cooking vessel is placed on top of a heater unit.

Another object of the present invention is to provide an apparatus and method for sensing load of an electric cooker capable of accurately detecting whether a cooking vessel is made of a magnetic or non-magnetic substance when the cooking vessel is placed on top of a heater unit.

A further object of the present invention is to provide an apparatus and method for sensing load of an electric cooker capable of selectively and automatically operating an induction heater or an electric heater according to presence or absence and kind of a cooking vessel placed on a heater unit.

A still further object of the present invention is to provide an apparatus and method for sensing load of an electric cooker capable of operating both an induction heater and an electric heater to allow a cooking vessel to be quickly heated when the cooking vessel is made of a magnetic substance.

In the present invention, an input current supplied to an induction heating coil and a resonance current flowing into the induction heating coil are detected and the kind of a cooking vessel is determined by the detected input current and resonance current.

Further, changes in temperature of a heater unit are detected while an electric heater is operated, and whether a cooking vessel is placed is determined by the detected changes of temperature.

If it is determined that a cooking vessel made of a magnetic substance is placed on the heater unit, the induction coil or electric heater is operated to heat the cooking vessel.

Further, if it is determined that a cooking vessel made of a non-magnetic or nonmetallic substance is placed on the heater unit, only the electric heater is operated to heat the cooking vessel.

Furthermore, if it is determined that it is in a no-load state where no cooking vessel is placed on the heater unit, neither the induction coil nor the electric heater are operated.

According to an aspect of the present invention for achieving the objects, there is provided an apparatus for sensing load of an electric cooker, comprising: a heater unit disposed with an induction heating coil and an electric heater; a load-type determination unit for determining a type of a cooking vessel placed on top of the heater unit; a load-state determination unit for determining whether the cooking vessel is placed on top of the heater unit; a heater driving determination unit for determining whether to operate the induction heating coil or electric heater in response to determination signals of the load-type determination unit and the load-state determination unit; a heater driving unit for operating the induction heating coil or the electric heater in response to determination of the heater driving determination unit; and a resonance unit for allowing a resonance current to flow into the induction heating coil when the heater driving unit operates the induction heating coil.

According to another aspect of the present invention, there is provided a method for sensing load of an electric cooker, comprising: determining a kind of a cooking vessel placed on a heater unit while an induction heating coil is operated; determining presence or absence of the cooking vessel placed on the heater unit while an electric heater is operated; selectively operating the induction heating coil or the electric heater when it is determined that the cooking vessel is placed on the heater unit and made of metal; and operating the electric heater when the cooking vessel is placed on the heater unit and made of a non-metallic material.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION

Hereinafter, a preferred embodiment of a load sensing apparatus and method of the present invention will be described in detail with reference to the accompanying drawings. If it is determined that detailed descriptions on functions and constructions well known to those skilled in the art may make the scope of the present invention obscure, they will be omitted herfrom.

Figure 1:
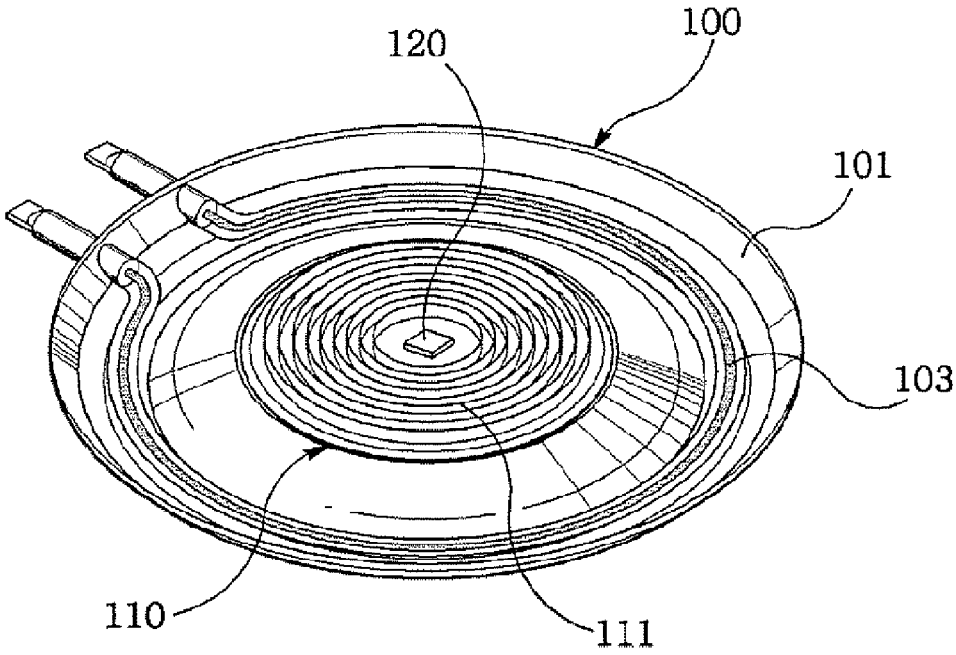
FIG. 1 is a perspective view showing the configuration of a heater unit used in a load sensing apparatus of the present invention.
Figure 2:
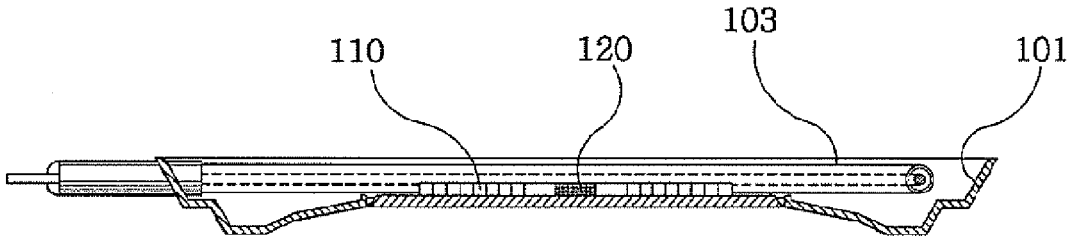
FIG. 2 is an enlarged sectional view showing the configuration of a heater unit used in a load sensing apparatus of the present invention.

FIGS. 1 and 2 are perspective and enlarged sectional views showing the configuration of a heater unit used in a load sensing apparatus of the present invention, respectively. Referring to FIGS. 1 and 2, the heater unit of the present invention comprises an electric heating portion (100) and an induction heating portion (110).

The electric heating portion (100) includes a reflection plate (101) and an electric heater (103). The reflection plate (101) reflects radiant energy generated from the electric heater (103) to a cooking vessel (not shown in the figures) placed on the top of the heater unit to enhance heating efficiency.

A hollow space is formed at the center of the electric heating portion (100), and the induction heating portion (110) is positioned within the hollow space.

The structure and material of the electric heating port on (100) may be modified in various ways, if necessary. Further, the electric heater (103) generates heat due to the supply of electric power and takes the shape of a ring. Preferably, the electric heater (103) is made of a carbon heater whose heating efficiency is relatively superior because of using a carbon heating element. It should be apparent that various kinds of heaters including a radiant heater may be used, it necessary.

The induction heating portion (110) has a structure in which an induction heating coil (111) winds in the form of a circular plate. High frequency current is supplied to the induction heating coil (111), and high frequency magnetic flux is generated from the induction heating coil (111) according to the high frequency current. The generated high frequency magnetic flux is induced to a cooking vessel due to an induction effect such that an eddy current is generated in the cooking vessel. Further, the Joule heat is generated in a resistance portion of the cooking vessel by the eddy current such that the cooking vessel is heated.

The electric heating portion (100) may be used to heat not only both a cooking vessel made of a magnetic substance containing iron ingredients and a cooking vessel made of a non-magnetic substance containing no iron ingredients but also a cooking vessel made of a non metallic material such as ceramic, glass or porcelain. Further, when a cooking vessel made of a magnet-c substance is heated, the induction heating portion (110) can have heating efficiency higher than that of the electric heating portion (100).

In addition, a temperature sensor (120) for detecting a temperature of the heater unit is installed at the center of the induction heating portion (110).

Figure 3:
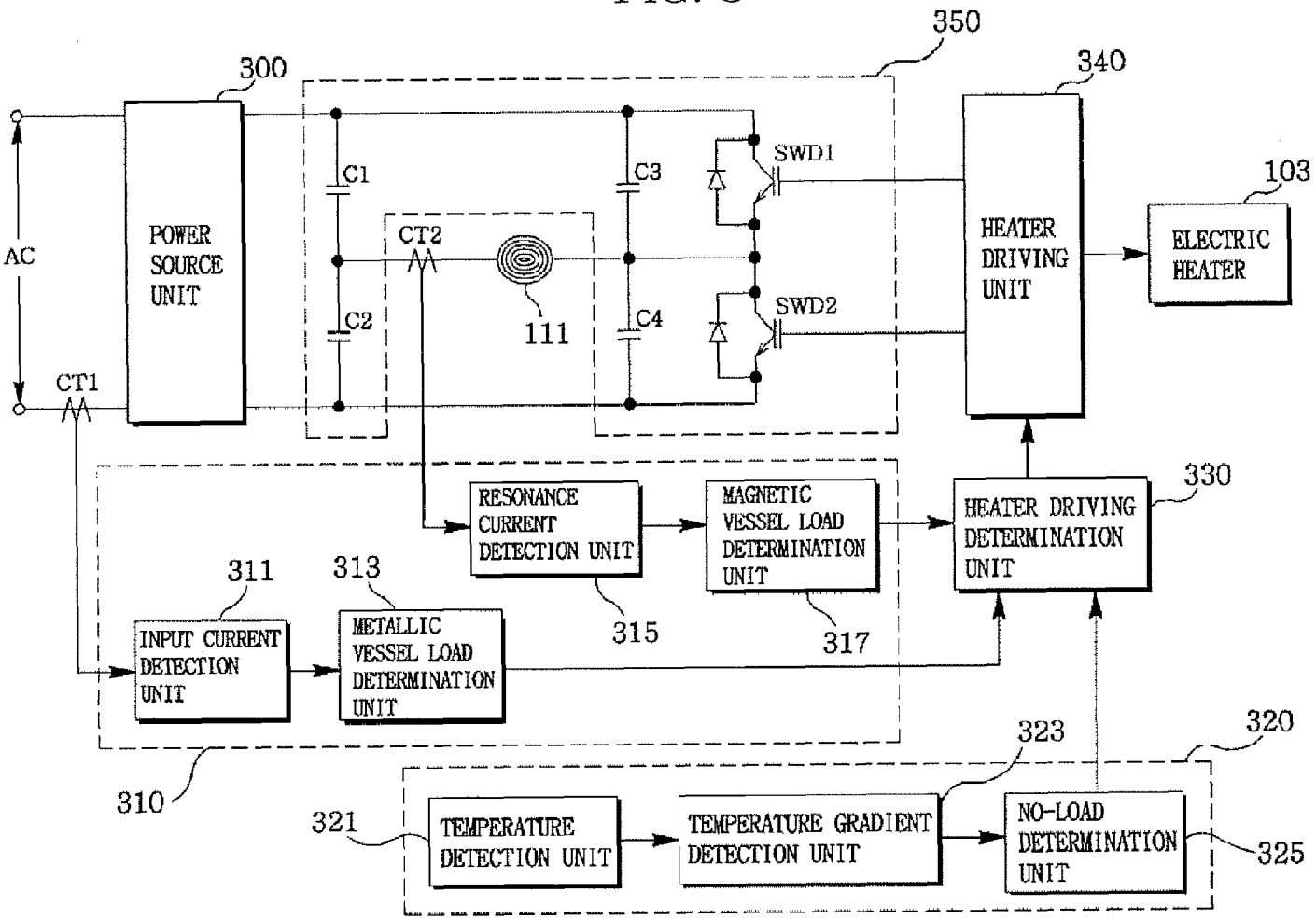
FIG. 3 is a circuit diagram of the load sensing apparatus of the present invention.

FIG. 3 is a circuit diagram of the load sensing apparatus of the present invention. Here, reference symbol AC denotes an alternating current (AC) power source and reference numeral 300 denotes a power source unit. The power source unit (300) converts the AC power source (AC) into a direct current (DC) power source, and the converted DC power source is supplied as a driving power source of the induction heating coil (111).

Reference numeral 310 denotes a load-type determination unit. The load-type determination unit (310) comprises: a first determination unit for determining presence or absence of load according to a cooking vessel made of a metallic or non-metallic material; and a second determination unit for determining the presence or absence of load according to a cooking vessel made of a magnetic or non-magnetic substance.

The first determination unit comprises: an input current detection unit (311) for detecting an input current using a current detecting element (CT1) such as a current transformer installed to a line where the AC power source is inputted to the power source unit (300); and a metallic vessel load determination unit (313) for determining whether a cooking vessel placed on the heater unit is made of metal using the input current detected by the input current detection unit (311).

The second determination unit comprises; a resonance current detection unit (315) for detecting a resonance current flowing into the induction heating coil (111) using a current detection element (CT2); and a magnetic vessel load determination unit (317) for determining whether a cooking vessel placed on the heater unit is made of a magnetic substance using the resonance current detected by the resonance current detection unit (315).

Reference numeral 320 denotes a load-state determination unit. The load-state determination unit (320) comprises: a temperature detection unit (321) for detecting a temperature of the heater unit using the temperature sensor (120) installed in the heater unit; a temperature gradient detection unit (323) for detecting a gradient per unit time of a temperature detected by the temperature detection unit (321); and a no-load determination unit (325) for determining whether the electric cooker is in a no-load state where the cooking vessel is not placed on the top of the heater unit using the temperature gradient detected by the temperature gradient detection unit (323).

Reference numeral 330 denotes a heater driving determination unit. If it is determined by the load-state determination unit (320) that that the electric cooker is in a no-load state where the cooking vessel is not placed on top of the heater unit, the heater driving determination unit (330) allows both the electric heater (103) and she induction heating coil (111) not to be operated. Further, if it is determined in the load-state determination unit (320) that that the electric cooker is in a loaded state where the cooking vessel 11 is placed on the top of the heater unit, the heater driving determination unit (330) allows the electric heater (103) or the induction heating coil (111) to be driven according to the type of load determined by the load-type determination unit (310).

Reference numeral 340 denotes a heater driving unit. The heater driving unit (340) operates the electric heater (103) or the induction heating coil (111) in accordance with the determination of the heater driving determination unit (330).

Reference numeral 350 denotes a resonance unit. Where the heater driving unit (340) generates a driving signal for operating the induction heating coil (111), the resonance unit (350) allows a resonance current to flow into the induction heating coil (111) in response to the driving signal.

In the resonance unit (350), capacitors (C1, C2) and capacitors (C3, C4) are respectively connected in series between output terminals of the power source unit (300) and the induction heating coil (111) is connected between connection points of the capacitors (C1, C2) and the capacitors (C3, C4) Further, switching elements (SWD1, SWD2) such as IGBT (Insulated Gate Bipolar Transistor) are connected in series between the output terminals of the power source unit (300). Furthermore, a connection point of the switching elements (SWD1, SWD2) is connected to the connection point of the capacitors (C3, C4) and the induction heating coil (111), and the heater driving unit (340) is connected to gates of the switching devices (SWD1, SWD2) such that a driving signal outputted from the heater driving unit (340) is applied to the gates of the switching elements.

In the load sensing apparatus of the present invention so configured, when a user instructs an electric cooker to be operated, the power source unit (300) rectifies and smoothes an AC power source (AC) to output a DC power source.

Further, the heater driving determination unit (330) determines in such a manner that the heater driving unit (340) causes the induction heating coil (111) to be operated for a predetermined period of time.

Then, the heater driving unit (340) outputs a driving signal to the induction heating coil (111), and thus, the switching elements (SWD1, SWD2) are alternately operated in response to the output driving signal.

When the switch element (SWD1) is turned on, a DC power source outputted from the power source unit (300) flows sequentially through the switching element (SWD1), the induction heating coil (111) and the capacitor (C2). Further, when the switching element (SWD2) is turned on, a DC power source outputted from the power source unit (300) flows sequentially through the capacitor (C1), the induction heating coil (111) and the switching element (SWD2). The capacitors (C3, C4) function to reduce switching loss generated when each of the switching elements (SWD1, SWD2) performs a switching operation.

Here, as the switching speed of the switching elements (SWD1, SWD2) is increased, a high frequency current flows into the induction heating coil (111) to generate high frequency flux.

In such a state, the input current detection unit (311) of the load-type determination unit (310) detects an input current flowing into the induction heating coil (111) using the current detecting element (CT1), and the metallic vessel load determination unit (313) determines the presence or absence of a metallic vessel load based on a level of the detected input current.

In wit, when a cooking vessel made of a metallic material is placed on top of the heater unit, high frequency flux generated from the induction heating coil (111) is induced into the cooking vessel made of a metallic material as an eddy current. Therefore, a lot of input current flows into the induction heating coil (111).

Further, when there is no-load where no cooking vessel is placed on top of the heater unit or when a cooking vessel made of a non-metallic material such as ceramic, glass or porcelain is placed on the heater unit, the high frequency flux generated from the induction heating coil (111) is not induced into the cooking vessel such that a very small amount of input current flows into the induction heating coil (111).

The metallic vessel load determination unit (313) compares an input current detected by the input current detection unit (311) with a predetermined reference current. If it is determined that the input current is greater than the reference current, the metallic vessel load determination unit (313) decides in such a manner that the cooking vessel placed on top of the heater unit is made of a metallic material and generates a determination signal indicating the presence of the metallic vessel load to output the determination signal to the heater driving determination unit (330).

If it is determined that the input current is lower than the reference current, the metallic vessel load determination unit (313) decides in such a fashion that the cooking vessel placed on top of the heater unit is made of a non-metallic material and generates a determination signal indicating the presence of the non-metallic vessel load to output the determination signal to the heater driving determination unit (330).

Further, in the load-type determination unit (310), the resonance current detection unit (315) detects a resonance current flowing into the induction heating coil (111) using the current detecting element (CT2). Then, the magnetic vessel load determination unit (317) determines the presence of magnetic vessel load based on a level of the detected resonance current.

That is, when a cooking vessel made of a magnetic substance is placed on top of the heater unit, the induction heating coil (111) is resonated while an eddy current is induced from the induction heating coil (111) to the cooking vessel made of a magnetic substance such that a very small amount of resonance current flows into the induction heating coil (111). Further, there is no-load where no cooking vessel is placed on top of the heater unit or when a cooking vessel made of a non-magnetic substance is placed thereon, the induction heating coil (111) is not resonated such that a large amount of resonance current flows into the induction heating coil (111).

The magnetic vessel load determination unit (317) compares the resonance current detected by the resonance current detection unit (315) with a predetermined reference current. If it is determined that the resonance current is greater than the reference current, the magnetic vessel load determination unit (317) decides in such a way that the cooking vessel placed on top of the heater unit is made of a magnetic substance and generates a determination signal indicating the presence of the magnetic vessel load to output the determination signal to the heater driving determination unit (330). Further, if it is determined that the resonance current is lower than the reference current, the magnetic vessel load determination unit (317) decides in such a manner that the cooking vessel placed on top of the heater unit is made of a non-magnetic substance and generates a determination signal indicating the presence of the non-magnetic vessel load to output the determination signal to the heater driving determination unit (330).

Furthermore, the heater driving determination unit (330) determines in such a way that the heater driving unit (340) causes the electric heater (103) to be operated for a predetermined period of time.

Then, the heater driving unit (340) supplies a power source to the electric heater (103) to allow heat to be generated from the electric heater (103).

Under this circumstance, the temperature detection unit (321) of the load-state determination unit (320) detects a temperature of the heater unit using the temperature sensor (120), and the temperature gradient detection unit (323) detects a temperature gradient based on the temperature detected by the temperature detection unit (321).

If the temperature gradient is detected, the no-load determination unit (325) determines, on the basis of the detected temperature gradient, whether a cooking vessel is placed on top of the heater unit.

That is, when a cooking vessel is placed on top of the heater unit, the heat generated from the electric heater (103) is transmitted to the cooking vessel. Therefore, since there is a small change in temperature, the temperature gradient is subsequently small. Further, if there is a no-load where no cooking vessel is placed on top of the heater unit, the heat generated from the electric heater (103) is not transmitted to the cooking vessel. Therefore, since there is a big change in temperature, the temperature gradient is also high.

The no-load determination unit (325) compares the temperature gradient detected by the temperature gradient detection unit (323) with a predetermined temperature gradient. If it is determined that the detected temperature gradient is greater than the predetermined gradient, the no-load determination unit (325) decides in such way that the electric cooker is in a no-load state. If it is determined that the detected temperature gradient is smaller than the predetermined gradient, the electric cooker is not in a no-load state. Consequently, the no-load determination unit (325) generates a determination signal by determining that the electric cooker is in a no-load state. The determination signal generated from the no-load determination unit (325) is inputted to the heater driving determination unit (330).

The heater driving determination unit (330) determines in such a way that the induction heating coil (111) and the electric heater (103) are not to be operated if the metal vessel load determination unit (313) discriminates that the cooking vessel is not a metallic vessel load.

Further, if it is determined by the metallic vessel load determination (313) that the cooking vessel is a metallic load, the magnetic vessel load determination unit (317) discriminates whether the cooking vessel is a magnetic load or a non-magnetic vessel load.

If the magnetic vessel load determination unit (317) determines that the magnetic vessel load is present, the heater driving determination unit (330) decides to operate the induction heating coil (111) and the electric heater (103). Then, the heater driving unit (340) operates the electric heater (103) to generate heat in response to the decision of the heater driving determination unit (330), outputs a driving signal to the resonance unit (350) and operates the resonance unit (350) by allowing a high frequency current to flow into the induction heating coil (11.1) while the switching elements (SWD1, SWD2) are alternately turned on and off in response to the output driving signal.

Alternatively, if it is determined that the magnetic vessel load determination unit (317) determines that the non-magnetic vessel load is present, the heater driving determination unit (330) decides to operate the electric heater (103). Then, the heater driving unit (340) operates the electric heater (103) to generate heat in response to the decision of the heater driving determination unit (330).

Figure 4:
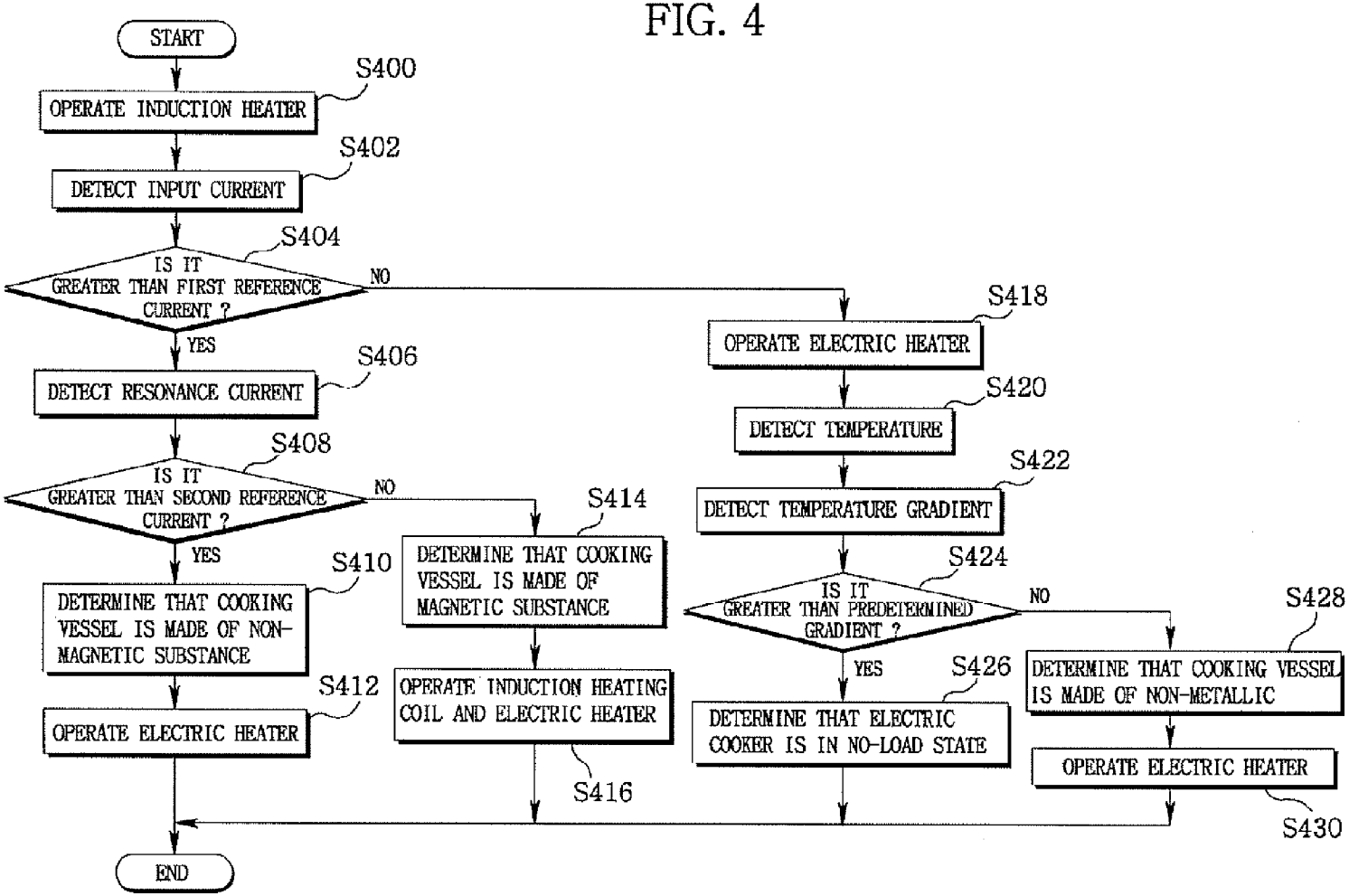
FIG. 4 is a signal flowchart illustrating a load sensing method of the present invention.

Meanwhile, FIG. 4 is a signal flowchart illustrating a load sending method of the present invention. Referring to FIG. 4, when a driving instruction for an electric cooker is inputted, the heater driving unit (340) outputs a driving signal to the resonance unit (350) to operate the induction heating coil (111) in response to the decision of the heater driving determination unit (330) (S400).

In such a state, the input current detection unit (311) detects an input current in accordance with the operation of the induction heating coil (111) using the current detecting element (CT1) (S402). Further, the metallic vessel load determination unit (313) compares the detected input current with a first predetermined reference current to determine whether the input current is greater than the first reference current (S404).

If it is determined that the input current is greater than the first reference current, the metallic vessel load determination unit (313) determines that a cooking vessel made of a metallic material is placed on the heater unit and generates a determination signal indicating the presence of the metallic vessel load to forward the generated signal to the heater driving determination unit (330).

If the metallic vessel load determination unit (313) determines that the metallic vessel load is present, the resonance current detection unit (315) detects a resonance current flowing into the induction heating coil (111) using the current detecting element (CT2) (S406). Successively, the magnetic vessel load determination unit (317) compares the resonance current detected by the resonance current detection unit (315) with a second predetermined reference current (S408).

Where the resonance current is greater than the second reference current, the magnetic vessel load determination unit (317) determines that the metallic vessel load is a cooking vessel made of a non-magnetic substance (S410) and generates a determination signal indicating the presence of the non-magnetic vessel load to output the determination signal to the heater driving determination unit (330).

Now, the heater driving determination unit (330) decides to operate the electric heater (103) in response to the determination signal of the magnetic vessel load determination unit (317) and the heater driving unit (340) supplies a power source to the electric heater (103) to operate the electric heater (103) in response to the decision of the magnetic vessel load determination unit (317) (S412).

Where the resonance current is lower than the second reference current as compared in step 408, the magnetic vessel load determination unit (317) determines that the metallic vessel load is a cooking vessel made of a magnetic substance (S414) and generates a determination signal indicating the presence of the magnetic vessel load to output the determination signal to the heater driving determination unit (330).

Then, the heater driving determination unit (330) decides to operate the induction heating coil (111) and the electric heater (103) in response to the determination signal from the magnetic vessel load determination unit (317). The heater driving unit (340) supplies a power source to the electric heater (103) to operate the electric heater (103) in response to the decision of the heater driving determination unit (330) and simultaneously outputs a driving signal to the resonance unit (350) to operate the induction heating coil (111) (S416).

Here, if it is determined that the cooking vessel placed on the heater unit is made of a magnetic substance, only the induction heating coil (111) may be driven, instead of both the induction heating coil (111) and the electric heater (103) being operated.

Further, if it is determined in step S404 that the input current is less than the first reference current, i.e. if it is determined that the cooking vessel placed on the heater unit is made of a non-magnetic substance or there is no-load, the heater driving determination unit (330) allows the heater driving unit (340) to operate the electric heater (103) for a predetermined period of time (S418).

Under this circumstance, the temperature detection unit (321) detects a temperature using the temperature sensor (120) if the electric heater (103) is operated (S420), and the temperature gradient detection unit (323) then detects a temperature gradient based on the temperature detected by the temperature detection unit (321) (S422).

If the temperature gradient is detected, the no-load determination unit (325) determines whether the detected temperature gradient is greater than a predetermined temperature gradient (S424). If it is determined that the detected temperature gradient is greater than the predetermined gradient, the no-load determination unit (325) determines the current state as a no-load state where no cooking vessel is placed on the top of the heater unit (S426) whereby the heater driving determination unit (330) can decide not to operate the induction heating coil (111) and the electric heater (103).

Further, as a result of the determination, if it is determined that the detected temperature gradient is less than the predetermined gradient, the current state is determined as a state where a cooking vessel made of a non-metallic material is placed on the top of the heater unit (S428). Then, the heater driving determination unit (330) decides to operate the electric heater (103) and causes the heater driving unit (340) to operate the electric heater (103) (S430).

Meanwhile, in the foregoing, the kind of a cooking vessel is first determined, and it is then determined whether the cooking vessel is placed on the heater unit if kind of the cooking vessel has not been determined.

The present invention is not limited to the foregoing. That is, it is first determined whether a cooking vessel is placed on the heater unit, and then, the kind of the cooking vessel may be determined when the cooking vessel is placed on the heater unit.

However, prior determination of presence or absence of cooking vessel and later determination of kind of cooking vessel require much time before the cooking vessel starts to be heated, compared with prior determination of kind of cooking vessel and later determination of presence or absence of cooking vessel.

That is, if the presence and absence of a cooking vessel is to be determined as described above, an electric heater should be first operated and then the change in the temperature gradient by the heat generation from the electric heater should be detected, such that a considerable time is required before the change in the temperature gradient is detected. On the to other hand, since the kind of the cooking vessel is determined based on the magnitude of input current and resonance current as described above, the kind of the cooking vessel can be determined within a very short time.

Therefore, if the presence or absence of a cooking vessel is first determined and the kind of the cooking vessel is then determined, the heating of the cooking vessel can be started after lapse of a considerable time before the presence or absence of a cooking vessel is determined, and after determination of the kind of the cooking vessel.

However, if the kind of a cooking vessel is first determined and the presence or absence of the cooking vessel is then determined, the cooking vessel can be heated immediately after the kind of the cooking vessel is determined. Further, even if the kind of the cooking vessel is not determined, the cooking vessel can be heated after the presence or absence of a cooking vessel has been determined. Therefore, the heating of the cooking vessel can be started after lapse of same time as in a case where the presence or absence of a cooking vessel is first determined and the kind of the cooking vessel is then determined.

Accordingly, it is preferable to determine the kind of a cooking vessel and then the presence or absence of the cooking vessel, as described above in the present invention.

As described above, the present invention is configured in such a manner that, in an electric cooker provided both with an induction heating coil and an electric heater, the presence or absence of a load and the kind of a cooking vessel are first determined, and the induction heating coil or electric heater can be selectively operated in accordance with a result of the determination.

Therefore, a user does not have to scrupulously determine the kind of a cooking vessel and be troubled about which to select between an induction heating coil and an electric heater as a result of the determination.

Further, even if the user inadvertently operates an electric cooker in a no-load state, the no-load state can be automatically sensed to prevent the induction heating coil and the electric heater from being operated. Therefore, the occurrence of safety accidents can be avoided in the first place.

Although the present invention has been described in detail in connection with the specific embodiments, it will be readily understood by those skilled in the art that various modifications and changes can be made thereto within the technical spirit and scope of the present invention. It is apparent that the modifications and changes fall within the scope of the present invention defined by the appended claims.

What is claimed is:

1. An apparatus for sensing load of an electric cooker, comprising:

a heater unit including an induction heating coil and an electric heater;

a load-type determination unit that determines a type of a cooking vessel;

a load-state determination unit that determines whether the cooking vessel is placed on top of the heater unit;

a heater driving determination unit that determines whether to operate the induction heating coil or the electric heater in response to determination signals of the load-type determination unit and the load-state determination unit;

a heater driving unit that operates the induction heating coil or the electric heater in response to a decision of the heater driving determination unit; and a resonance unit that allows a resonance current to flow into the induction heating coil when the heater driving unit operates the induction heating coil, wherein the load-type determination unit comprises:

a first determination unit that determines whether a cooking vessel placed on top of the heater unit is a metallic load or a non-metallic load by an input current flowing in a line of an alternating current power source when the induction heating coil is driven; and a second determination unit that determines whether the cooking vessel placed on top of the heater unit is a magnetic load or a non-magnetic load by a resonance current flowing into the induction heating coil when the induction coil is driven.

2. The apparatus as claimed in claim 1, wherein the first determination unit comprises:

an input current detection unit that detects an input current of an AC power source when the induction heating coil is operated; and a metallic vessel load determination unit that determines whether the cooking vessel is made of metal on the basis of a magnitude of the input current detected by the input current detection unit.

3. The apparatus as claimed in claim 1, wherein the second determination unit comprises:

a resonance current detection unit that detects a resonance current flowing into the induction heating coil; and a magnetic vessel load determination unit that determines whether the cooking vessel is made of a magnetic substance on the basis of a magnitude of the resonance current detected by the resonance current detection unit.

4. The apparatus as claimed in claim 1, wherein the load-state determination unit comprises:

a temperature sensor installed at the heater unit;

a temperature detection unit that detects a temperature of the heater unit using the temperature sensor;

a temperature gradient detection unit that detects a gradient of the temperature detected by the temperature detection unit; and a no-load determination unit that determines whether the electric cooker is in a no-load state where no cooking vessel is placed on top of the heater unit on the basis of the temperature gradient detected by the temperature gradient detection unit.

5. The apparatus as claimed in claim 1, wherein the resonance unit comprises:

two switching elements alternately turned on and off in response to a driving signal outputted from the heater driving unit; and two capacitors resonated with the induction heating coil to allow the resonance current to flow into the induction heating coil when the two switching elements are selectively turned on.

6. The apparatus as claimed in claim 5, further comprising two capacitors respectively connected in parallel to the two switching elements to reduce switching loss generated as the two switching elements are alternately turned on or off.

7. A method for sensing load of an electric cooker, comprising:

determining whether a cooking vessel placed on a heater unit comprising an induction heating coil and an electric heater is made of metallic or non-metallic material by detecting an input current flowing in a line of an alternating current power source while operating the induction coil;

determining whether the cooking vessel is made of magnetic or non-magnetic material by detecting a resonance current flowing into the induction heating coil;

determining whether the cooking vessel is placed on the heater unit while operating the electric heater;

selectively operating the induction heating coil or the electric heater if it is determined that the cooking vessel is placed on the heater unit and on the basis of whether the cooking vessel is made of magnetic or non-magnetic material if it is determined that the cooking vessel is made of metal; and operating the electric heater when the cooking vessel is placed on the heater unit and made of a non-metallic material.

8. The method as claimed in claim 7, wherein the determining whether the cooking vessel is made of metallic or non-metallic material comprises;

comparing the input current with a first predetermined reference current;

determining that the cooking vessel is made of a metallic material if it is determined that the input current is greater than the first reference current; and determining that the cocking vessel is made of a non-metallic material if it is determined that the input current is lower than the first reference current.

9. The method as claimed in claim 7, wherein the determining whether the cooking vessel is made of magnetic or non-magnetic material comprises:

comparing the resonance current with a second predetermined reference current;

determining that the cooking vessel is made of non-magnetic material if it is determined that the resonance current is greater than the second reference current; and determining that the cooking vessel is made of magnetic material if it is determined that the resonance current is lower than the second reference current.

10. The method as claimed in claim 7, wherein the determining whether the cooking vessel is placed on the heater unit is based on a change in temperature of the heater unit according to the operation of the electric heater.

11. The method as claimed in claim 7, wherein the determining whether the cooking vessel is placed on the heater unit comprises:

detecting the temperature of the heater unit according to the operation of the electric heater;

detecting a temperature gradient of the detected temperature; and determining whether the cooking vessel is placed on the heater unit on the basis of the detected temperature gradient.

12. The method as claimed in claim 7, wherein the selectively operating the induction heating coil or the electric heater comprises:

operating the electric heater when the determined cooking vessel is made of non-magnetic metal; and operating the induction heating coil when the determined cooking vessel is made of magnetic metal.

13. The method as claimed in claim 12, further comprising operating the electric heater together with the induction heating coil when the cocking vessel is made of the magnetic metal.

14. The method as claimed in claim 7, further comprising operating neither the induction heating coil nor the electric heater when no cooking vessel is placed on the top of the heater unit.

* * * * *

UNITED STATES PATENT AND TRADEMARK OFFICE

CERTIFICATE OF CORRECTION

PATENT NO. : 7,368,688 B2
APPLICATION NO. : 11/536722
DATED : May 6, 2008
INVENTOR(S) : Kim et al.

It is certified that error appears in the above-identified patent and that said Letters Patent is hereby corrected as shown below:

At column 13, line 15 (claim 8, line 9) of the printed patent, “cocking” should be --cooking--.

At column 14, line 21 (claim 13, line 3) of the printed patent, “cocking” should be --cooking--.

Signed and Sealed this

Sixteenth Day of December, 2008

JON W. DUDAS
*Director of the United States Patent and Trademark Office*